United States Patent [19]

Whitten, III

[11] Patent Number: 4,729,320

[45] Date of Patent: Mar. 8, 1988

[54] COMBUSTION EXHAUST ARROWHEAD

[75] Inventor: Robert G. Whitten, III, c/o Kenneth L. Funderburk, P.O. Box 1025, Phenix City, Ala. 36868-1025

[73] Assignees: R. Larry Phillips, Columbus, Ga.; Kenneth L. Funderburk, Phenix City, Ala.; Robert G. Whitten, II, Columbus, Ga. ; a part interest to each

[21] Appl. No.: 54,803

[22] Filed: May 27, 1987

[51] Int. Cl.[4] ..... F41B 5/04

[52] U.S. Cl. ..... 102/371; 273/418; 273/422

[58] Field of Search ..... 273/418, 419, 420, 421, 273/422; 102/371, 497, 500, 511, 512, 501, 396, 397, 428, 429, 487, 488; 43/6

[56] References Cited

U.S. PATENT DOCUMENTS

| | | | |
|---|---|---|---|
| 1,318,954 | 10/1919 | Barlow | 102/397 |
| 1,897,709 | 2/1933 | Nigeradse | 102/488 X |
| 2,348,498 | 5/1944 | Robertson | 102/397 |
| 2,659,273 | 11/1953 | Trautmann | 102/371 X |
| 2,940,759 | 6/1960 | West | 273/420 |
| 3,599,569 | 8/1971 | Heartness | 102/371 |
| 3,747,247 | 7/1973 | McNair | 102/371 |
| 4,036,499 | 7/1977 | Sherwin | 273/422 |
| 4,100,855 | 7/1978 | O'Callaghan | 102/371 |
| 4,541,194 | 9/1985 | Mongiello, Jr. | 43/6 |

*Primary Examiner*—Paul E. Shapiro

*Attorney, Agent, or Firm*—Fleit, Jacobson, Cohn & Price

[57] ABSTRACT

An elongated tubular body is provided and which may include circumferentially spaced, generally radially outwardly projecting and forwardly tapering blades. The body includes a rear end including structure for mounting the rear end of the body on the forward end of an arrow shaft and the forward end of the body defines a counterbore in which a rearwardly facing rim fire cartridge may be chambered. The body includes lateral ports formed therein rearward of the cartridge and the forward end of the body removably mounts a tubular plug for maintaining the cartridge seated in the counterbore and supporting a longitudinally reciprocal firing pin including a diametrically enlarged head portion forward of the plug and a rear primer area impacting portion for contact with the rim primer area of the cartridge upon sharp rearward displacement of the firing pin relative to the plug. When the cartridge is fired as a result of the firing pin impacting therewith the rapidly expanding gases from the cartridge are vented through the body ports and into the target in which the arrowhead has penetrated.

10 Claims, 6 Drawing Figures

COMBUSTION EXHAUST ARROWHEAD

BACKGROUND OF THE INVENTION

1. Field of the Invention

This invention relates to a hollow arrowhead for mounting on the forward end of an arrow shaft and with the arrowhead including structure for chambering a rearwardly facing blank cartridge therein, provided with lateral ports rearward of the blank cartridge for venting the interior of the arrowhead to the exterior thereof and with elongated firing pin structure supported from the head for reciprocation relative thereto, including a forward end for impacting with a target and a rear end disposed for impact with the ignition primer area of the rearwardly facing blank cartridge chambered in the head. The forward end of the firing pin structure, upon impact with a target, rearwardly and the rear end thereof impacts with the ignition primer area of the blank cartridge whereby the latter is discharged and the expanding gases discharged therefrom pass outward through the body through the lateral ports and into the target.

2. Description of Related Art

Various different forms of arrowheads having cartridges operatively associated therewith as well as other types of explosive charges and including various structures for facilitating rapid kill of an animal heretofore have been provided. Examples of these previously known forms of arrowheads and similar devices are disclosed in U.S. Pat. Nos. 2,620,190, 2,667,814, 2,940,759, 2,970,399, 3,066,940, 3,565,435, 3,580,172, 3,878,788 and 4,541,194. However, these previously known devices do not include the relatively simple combination of structural features of the instant invention which functions in a desirable manner to insure rapid kill of a target animal.

SUMMARY OF THE INVENTION

The arrowhead of the instant invention may be mounted upon the forward ends of various different forms of arrow shafts and is self-contained for efficient operation when mounted on substantially any form of arrow shaft. The arrowhead is hollow and chambers a rearwardly facing blank rim fire cartridge therein and is equipped with a firing pin mechanism shiftable relative to the head between a forward limit position and a rear limit position. The firing pin mechanism includes a forward extremity defining an impact member for impacting with a target and a rear portion comprising a firing pin portion for impacting with an ignition primer area of the blank cartridge. In addition the tubular body of the arrowhead includes lateral ports disposed rearward of the blank cartridge for venting the combustion gases from the cartridge to the exterior of the body of the arrowhead.

The main object of this invention is to provide an arrowhead for rapid kill of animal targets wherein the arrowhead carries a blank cartridge that is fired upon impact of the arrowhead with the target and the rapidly expanding gases of combustion of the cartridge are directed into the animal penetrated by the arrowhead.

Another object of this invention, in accordance with the preceding object, is to provide an arrowhead in accordance with the preceding object and which will utilize relatively inexpensive small caliber blank cartridges.

Still another object of this invention is to provide an arrowhead of the type described for removable mounting from the forward end of the conventional arrow shaft.

Yet another object of this invention is to provide a combustion-type arrowhead incorporating a safety mechanism which may be readily rendered inactive as the associated arrow is being nocked.

Another object of this invention is to provide a combustion arrowhead which may be equipped with conventional cutting blade portions, if desired.

A final object of this invention to be specifically enumerated herein is to provide an arrowhead in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
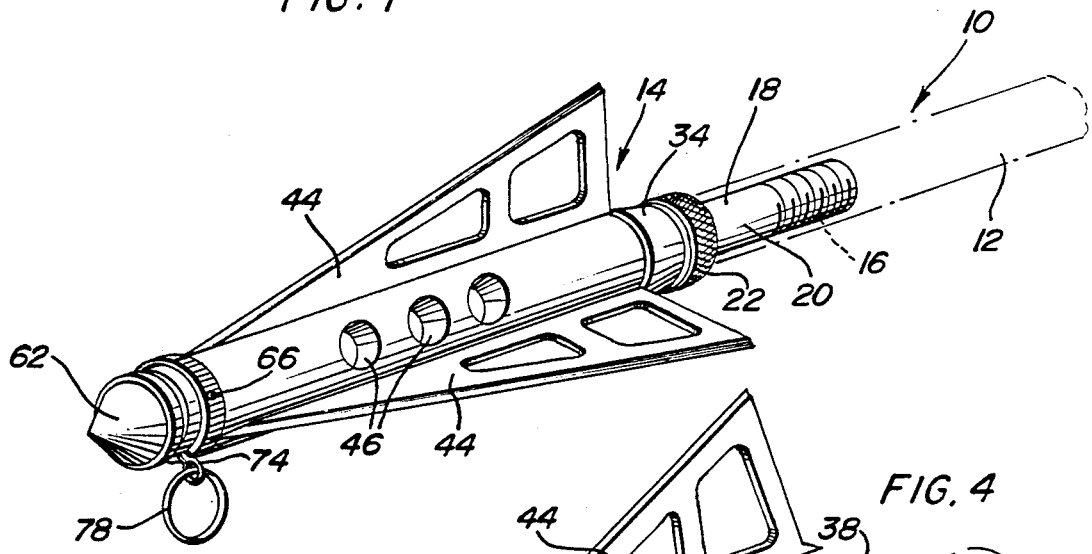
FIG. 1 is a perspective view of the arrowhead with the safety mechanism in operative position.
Figure 4:
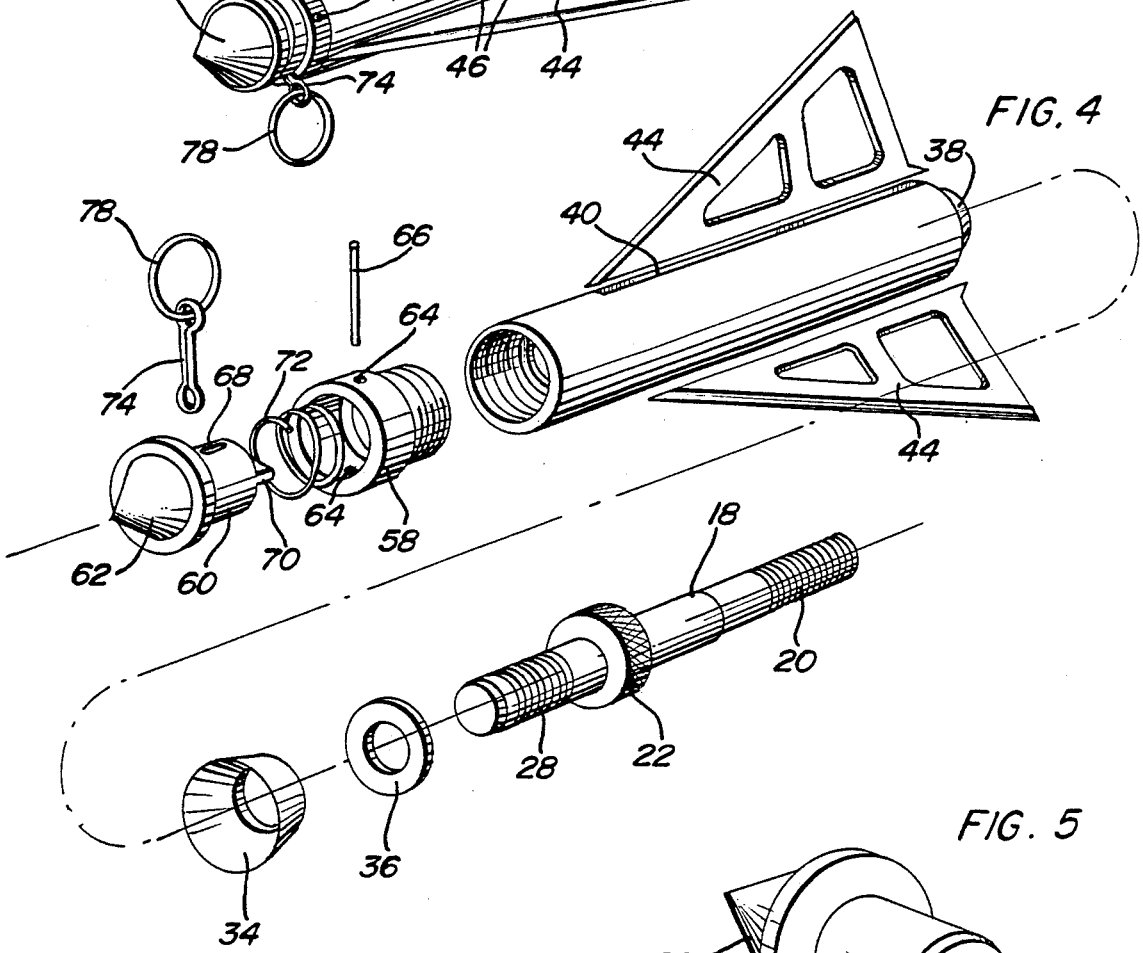
FIG. 4 is an exploded perspective view of the arrowhead.
Figure 5:
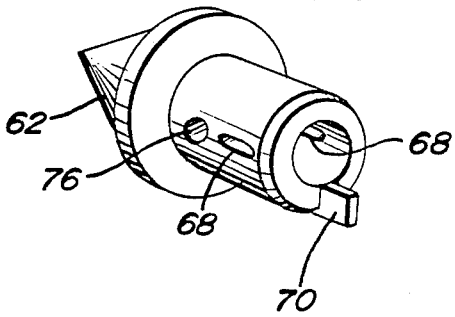
FIG. 5 is an enlarged perspective view of the target impacting firing pin portion of the arrowhead as seen from the rear end thereof.
Figure 2:
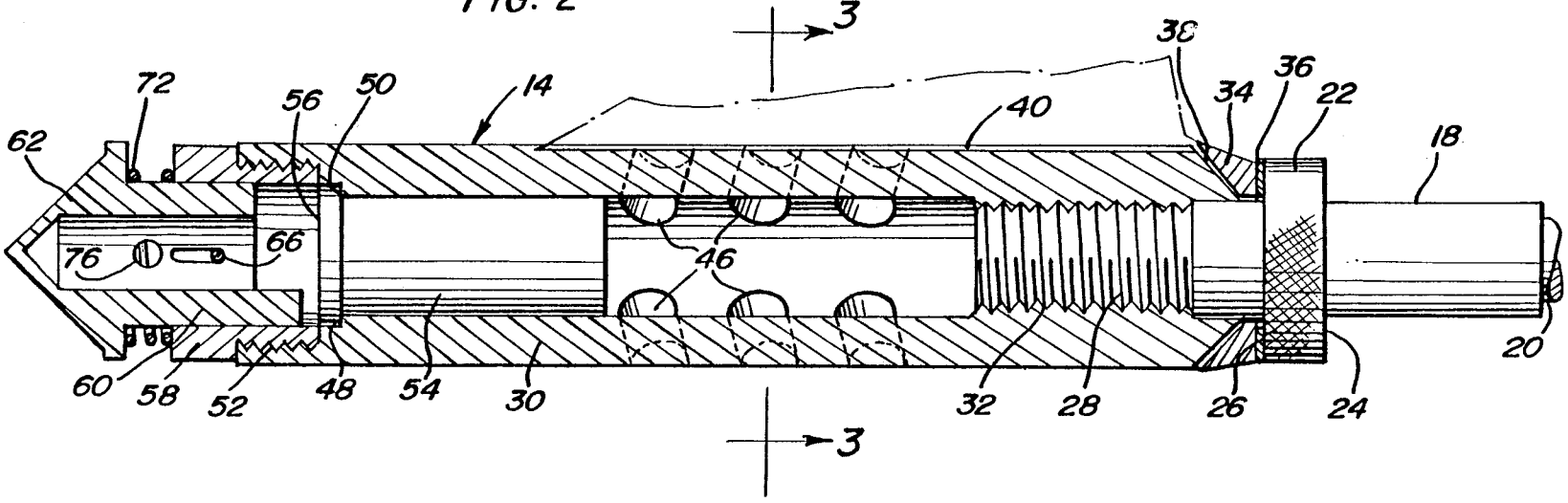
FIG. 2 is an enlarged longitudinal vertical sectional view of the arrowhead with the safety mechanism removed and the upper cutting blade fragmentarily illustrated in phantom lines.
Figure 3:
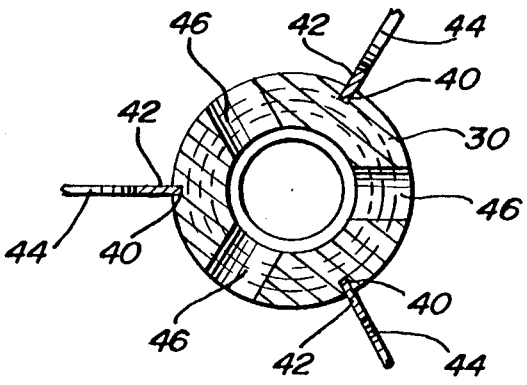
FIG. 3 is a transverse vertical sectional view taken substantially upon the plane indicated by the section line 3—3 of FIG. 2.

Referring now more specifically to FIGS. 1, 2 and 4 of the drawings, the numeral 10 generally designates an arrow including a shaft 12 equipped with a forward end arrowhead constructed in accordance with the present invention and generally referred to by the reference numeral 14. The arrow shaft 12 includes a forwardly opening threaded blind bore 16 and a conventional arrowhead mounting shank 18 is provided and includes a diametrically reduced rear threaded shank portion 20 removably threadedly engaged in the blind bore 16. The mounting shank 18 includes a central diametrically enlarged portion 22 defining a rearwardly facing shoulder 24 for abuttingly engaging the forward end of the arrow shaft 12 and a forwardly facing shoulder 26. In addition, the forward end of the mounting shank 18 includes a threaded shank portion 28, as is conventional.

The head 14 includes an elongated tubular body 30 which is internally threaded at its rear end as at 32 and threadedly mounted on the shank portion 28 with an annular blade retainer 34 and fibre compression washer 36 interposed between the frustoconical rear end face 38 of the body 30 and the forwardly facing shoulder 26. The exterior of the body 30 includes three peripherally spaced grooves 40 formed therein in which the inner marginal edge portions 42 of three cutting blades 44 are retained by the blade retainer 34.

The blades 44 are disposed on 120° relatively angulated radii of the tubular body 30 and the tubular body 30 includes three peripherally spaced sets of longitudinally spaced ports 46 disposed forward of the shank portion 28 and opening outwardly from the interior of the body 30 through the exterior thereof along radial planes of the body 30 centrally spaced between adjacent radial planes of the body 30 containing the blades 40. The ports 46 are slightly rearwardly and outwardly inclined and are formed in the body 30 substantially midway between the opposite ends thereof.

The forward end portion of the tubular body 30 includes a first smooth counterbore 48 defining a forwardly facing shoulder 50 and a second larger threaded counterbore 52 which opens through the forward end of the body 30. A rearwardly facing blank 22 caliber cartridge 54 is chambered within the body 30 with the base end flange 56 of the cartridge 54 seated against the shoulder 50.

A tubular plug 58 is removably threaded in the second blind bore 52 and the rear end of the plug 58 is slightly smaller in inside diameter than the outside diameter of the base end flange 56. Accordingly, the plug 58 engages the rear face of the flange 56 to maintain the cartridge 54 fully seated against the shoulder 50.

A cylindrical firing pin structure 60 is provided and is reciprocal within the plug 58. The forward end of the firing pin structure is diametrically enlarged and defines an impact head 62 which limits rearward shifting of the firing pin structure 60 relative to the plug 58 and the plug 58 includes diametrically opposite radial bores 64 in which the opposite ends of a cross pin 66 are received, the firing pin structure 60 including diametrically opposite longitudinal slots 68 formed therein slightly greater in width than the diameter of the pin 66 and in which the opposite end portions of the pin 66 are slidingly received, the slots 68 serving to limit both forward and rearward shifting of the firing pin structure 60 relative to the plug 58.

The cartridge 54 is of the rim fire type and the rear end of the firing pin structure 60 includes a firing pin portion 70 for impacting with the rear rim portion of the cartridge 54 defined by the base end flange 56. Thus, rearward impact of the firing pin portion 70 with the base end flange 56 is sufficient to discharge the cartridge 54.

Interposed between the forward head portion 62 of the firing pin structure 60 and the forward end face of the plug 58 is a light compression spring 72 which biases the firing pin structure 60 toward its forwardmost limit position and a diametric safety pin 74 is receivable through diametrically opposite radial bores 76 formed in the firing pin structure 60 rearward of the head portion 62 and forward of the plug 58, the pin 74 being removably mounted for preventing accidental rearward shifting of the firing pin structure 60 relative to the plug 58. As the arrow 10 is nocked, the pin 74 is removed by pulling on the ring 78 supported from one end thereof, thereby removing the safety and conditioning the arrowhead 14 for full operation.

Upon impact of the head portion 62 with a target, the firing pin structure 60 is shifted rearwardly relative to the plug 58 and impacts with the rim portion of the base end flange 56 in order to discharge the cartridge 54. Of course, the arrowhead 14 is moving rapidly at the time of impact of the head portion 62 with the target and penetrates the target at least to the ports 46 before any substantial portion of the expanding combustion gases from the cartridge 54 may exit through the ports 46. Therefore, substantially all of the expanding combustion gases from the cartridge 54 are discharged from the ports 46 into the target after the arrowhead 14 has penetrated the target at least to the ports 46.

Figure 6:
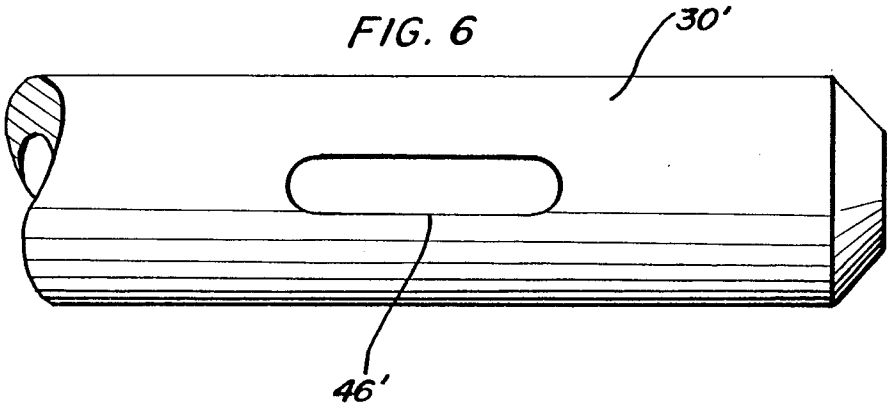
FIG. 6 is an enlarged fragmentary elevational view of a modified form of arrowhead body.

With attention invited more specifically to FIG. 6, a modified form of body 30′ may be seen. The body 30′ is substantially identical to the body 30, except that the sets of ports 46 provided in the body 30 are replaced by longitudinal slots 46′ formed in the body 30′.

Various different forms of materials may be used in the construction of the arrowhead 14. The arrowhead 14 may include the blades 44, or the slots 40 and blades 44 may be omitted, if desired.

The foregoing is considered as illustrative only of the principles of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention.

What is claimed as new is as follows:

1. An arrowhead for rapid kill of an animal, said arrowhead including an elongated tubular body having front and rear ends, said rear end of said body including mounting means for mounting said body on the forward end of an arrow shaft with said body substantially coaxial with the said shaft, the front end of said body including a counterbore defining a forwardly facing seat, a rearwardly facing blank cartridge telescoped into the front end of said body and including a base end equipped with a radially outwardly projecting base flange seated against said seat and a rearwardly facing ignition primer area for impact thereagainst by a firing pin, a tubular plug removably mounted from the front end of said body and engaged with said base end from forward of the latter to maintain said flange seated against said seat, elongated firing pin means lengthwise reciprocal relative to said tubular plug and disposed lengthwise relative to said body, said firing pin means including a forward target impact head portion projecting forward of said plug and comprising the forwardmost portion of said head and a rear firing pin portion aligned and disposed for impact with said ignition primer area upon rearward shifting of said firing pin means relative to said plug, said plug and firing pin means including coacting limit means establishing limits of reciprocation of said firing pin means relative to said plug, said body, rearward of said cartridge, including lateral port means formed therein opening outwardly from the interior of said body through the exterior thereof.

2. The arrowhead of claim 1 wherein said body includes circumferentially spaced and generally radially outwardly projecting and forwardly tapering blades.

3. The arrowhead of claim 2 wherein said port means include circumferentially spaced ports disposed between circumferentially adjacent blades.

4. The arrowhead of claim 1 including spring means operatively connected between said plug and firing pin means yieldingly biasing said firing pin means to its forward limit position of reciprocation relative to said plug.

5. The arrowhead of claim 4 including safety means removably engageable between said firing pin means and said plug for preventing rearward shifting of said firing pin means relative to said plug from the forward limit position of said firing pin means relative to said plug.

6. The arrowhead of claim 5 wherein said body includes circumferentially spaced and generally radially outwardly projecting and forwardly tapering blades.

7. The arrowhead of claim 6 wherein said port means include circumferentially spaced ports disposed between circumferentially adjacent blades.

8. The arrowhead of claim 1 wherein said lateral port means include a plurality of lateral ports peripherally spaced about said body.

9. The arrowhead of claim 1 wherein said port means include three sets of longitudinally spaced lateral ports formed in said body and spaced apart circumferentially about said body.

10. The arrowhead of claim 1 wherein said port means include a plurality of elongated port defining slots formed in said body and extending longitudinally thereof, said slots being angularly spaced apart about said body.

* * * * *